US005211114A

United States Patent [19]

Chaplin et al.

[11] Patent Number: 5,211,114

[45] Date of Patent: May 18, 1993

[54] OFFSHORE STRUCTURE PULLING SYSTEM

[75] Inventors: Paul D. Chaplin; Brian D. Hyde, both of Nairn; Edwin A. B. W. Campbell, Inverness, all of Scotland; Paul F. Gibson, Middlesbrough; Michael J. Taylor, South Yorkshire, both of England

[73] Assignees: McDermott International, Inc., New Orleans, La.; John Gibson (Lifting Gear) Agencies Ltd., London, England

[21] Appl. No.: 926,799

[22] Filed: Aug. 7, 1992

[51] Int. Cl.[5] ..... B61B 13/00

[52] U.S. Cl. ..... 104/134; 104/165; 104/212; 104/222

[58] Field of Search ..... 104/165, 169, 170, 171, 104/173.1, 176, 178, 212, 222, 162; 105/30, 84; 254/29, 93 R; 269/48.1, 234

[56] References Cited

U.S. PATENT DOCUMENTS

| | | | |
|---|---|---|---|
| 4,007,915 | 2/1977 | Chambers | 104/165 |
| 4,014,266 | 3/1977 | Näslund et al. | 104/134 |
| 5,150,656 | 9/1992 | Lobb et al. | 104/162 |

*Primary Examiner*—Mark T. Le

*Attorney, Agent, or Firm*—Robert J. Edwards; Michael L. Hoelter

[57] ABSTRACT

A pulling system for pulling or moving a large object, such as pulling components of an offshore oil/gas production platform onto an adjacent barge that is subsequently transported to the installation site. This pulling system incorporates a single elongated rod that is connected between the object to be moved and a puller unit that pulls the object along a track. During operation, the puller unit causes a gripping unit to grip the rod so that the puller unit can move the object. Afterwards, the gripping unit releases its engagement of the rod, repositions itself with respect to the rod, and regrips the rod so that movement of the object may again be initiated by the puller unit.

9 Claims, 5 Drawing Sheets

FIG. 11
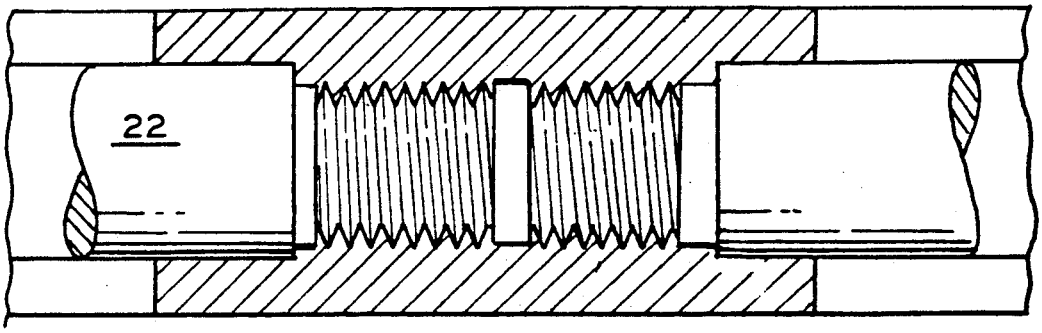
FIG. 12
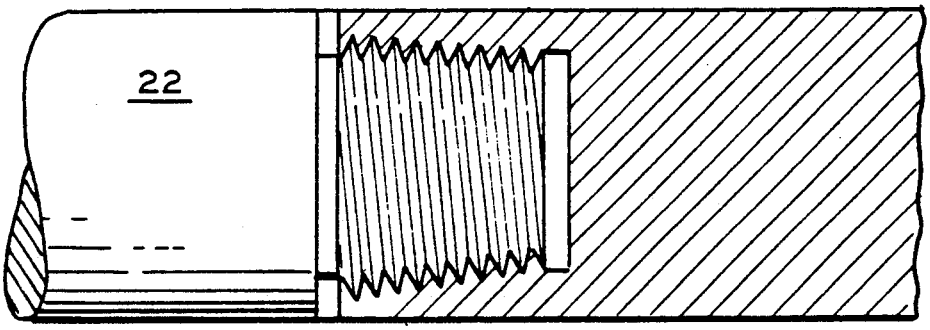
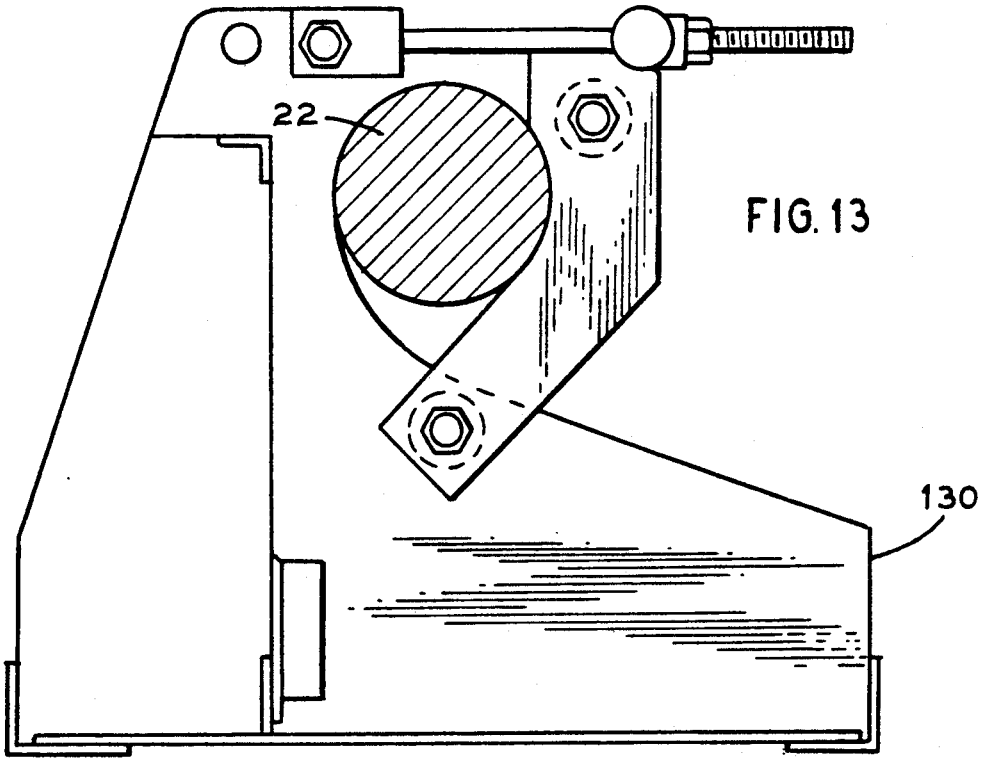
FIG. 13

OFFSHORE STRUCTURE PULLING SYSTEM

FIELD OF THE INVENTION

This invention relates to a system for moving very large objects, and particularly, but not exclusively, to a system for moving components used to form an oil/gas production platform.

BACKGROUND OF THE INVENTION

When constructing offshore production platforms, it is necessary to transport the components forming the platforms from the place where they are manufactured to the offshore location of the platform. In general, the components will be manufactured at a site located very close to a coast, and it will be necessary to move these components over distances of approximately 250 meters from the site onto a barge. Once on the barge, the components will be transported to a predetermined offshore location where they will be upended and lowered into the sea at the appropriate position.

Generally, offshore production platforms are extremely large structures, components forming the platform can weigh as much as about 22,500 tons or more. There are thus special problems associated with moving such large structures from the site of manufacture to a barge. A known apparatus for moving a large component comprises a frame having a skid track along which the component is moveable, and a pulling unit. A plurality of steel cables, typically 50 strands each, are attached first to the component to be moved and secondly to the frame. The pulling unit pulls the strands which in turn causes the component to move towards the desired location. The pulling unit comprises means for repeatedly gripping and then pulling the strands as they pass through the frame.

A disadvantage of this known apparatus is that many connections are required between the component and the strands. This is time consuming and expensive and results in a complicated structure. A second disadvantage is that the strands must be cut to a predetermined length suitable for the particular component being moved. A third disadvantage is that the strands must be cut to length, and it is therefore rarely possible to re-use the strands for a different job. A further disadvantage is the large elastic stretch which occurs when the strands are at high load; this large elastic energy results in highly dynamic initial movement of the structure. Additionally, each strand, wire or pull rod is under extreme tension and the failure of any one of them can be lethal.

SUMMARY OF THE INVENTION

According to the invention, there is provided a system for moving a large object, which comprises an elongated frame comprising a skid track along which the object is movable; a puller unit; and pulling means attachable to the object and connectable to the puller unit for enabling the object to be pulled along the skid track by means of the puller unit pulling on the pulling means. This invention is characterized in that the pulling means comprise a single rod formed from a plurality of rod sections connectable to one another to form a rod of a predetermined length.

By means of the system according to the present invention, fewer connections are necessary between the object to be moved and the rod. In fact, it is generally necessary only to connect the object to the rod at one point.

Previously it has not been thought possible to use a single rod of this type to pull such large objects. One of the reasons for this opinion is that it was thought that the logistics of using a rod of approximately 250 meters long meant that it would not be practical to use a rod. The present inventors have realized that by forming the rod from a plurality of rod sections, the problems associated with handling a rod of approximately 250 meters in length are avoided.

A further advantage of the system according to the present invention is that the rod sections are re-usable. Additionally, because only a single rod is used to pull the object, it is possible to reduce the vertical distance between the rod and the skid track. This results in a lower induced moment associated with the rod and means that the support structure may be smaller and more compact.

Preferably, adjacent rod sections are connected to each other by means of a screw thread. The screw thread may be any conventional screw thread, for example, a tapered screw thread or a balustrade screw thread.

Advantageously, the puller unit comprises a gripper unit for gripping the rod while the puller unit is pulling the rod. The gripper unit must be able to repeatedly grip the rod while the pulling action is occurring before releasing the rod and re-gripping the rod ready for the second pull of the puller unit. In this way, the rod will inch forward along the skid track and in turn will pull the object in the same direction.

The rod may comprise grooves formed at spaced apart intervals along the rod. The gripper unit may then comprise a unit formed from two or more wedge or block portions which completely surround the circumference of the rod, these wedge portions being formed to fit into the grooves on the rod. This groove structure enables the gripping unit to selectively and positively grip the rod during pulling.

Furthermore, should the rod comprise a substantially smooth surface, the gripper unit may comprise a plurality of taper portions or collets held within a crosshead. The fact that the portions are tapered means that once they are wedged within the crosshead they are able to securely grip the rod. To release the grip of the gripper unit, the crosshead is moved relative to the wedges to release the wedges from the collet.

Additionally, the object to be moved is attached to the rod by means of a connecting plate which allows relative movement between the object and the rod. This means that when the puller unit stops pulling the rod, momentum built up in the object may be dispersed by allowing the object to move relative to the rod without buckling the rod.

BRIEF DESCRIPTION OF THE DRAWINGS

FIGS. 11 and 12 are schematic illustrations of alternative screw threads which may be used to connect adjacent rod sections forming the rod.

FIG. 13 is a schematic diagram of a support structure supporting the rod at spaced intervals along the length of the frame.

DETAILED DESCRIPTION OF THE DRAWINGS

Figure 1:
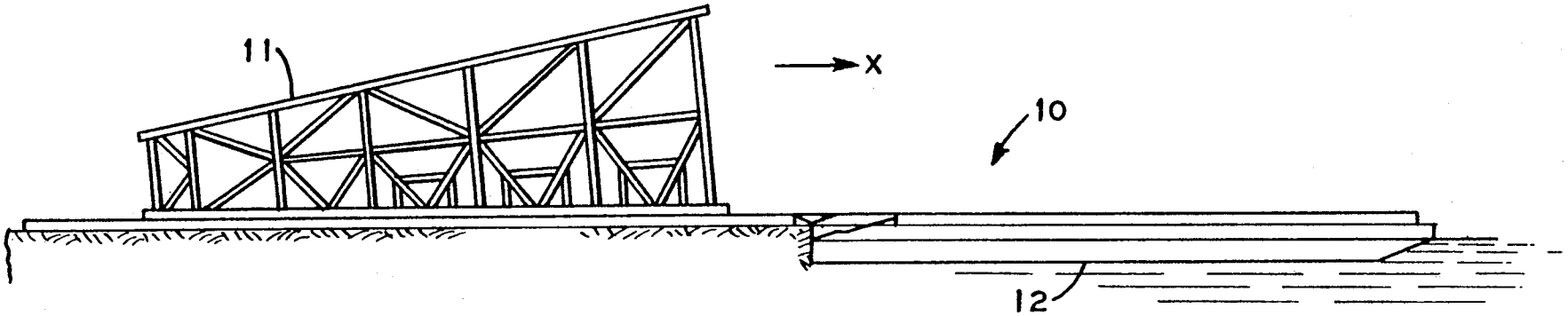
FIG. 1 is a schematic side view representation of the apparatus according to the present invention shown in use pulling a component of an oil rig.

Referring to FIG. 1, a pulling system according to the present invention is designated generally by the reference numeral 10. This system 10 may be used to pull a large component such as jacket 11, which is to form part of an oil rig, from the site of manufacture to barge 12 which may be used to transport component 11 to the appropriate location offshore. In this embodiment, component or jacket is about 22,500 tons in weight, more or less, and must be moved approximately 250 meters onto barge 12.

Figure 2:
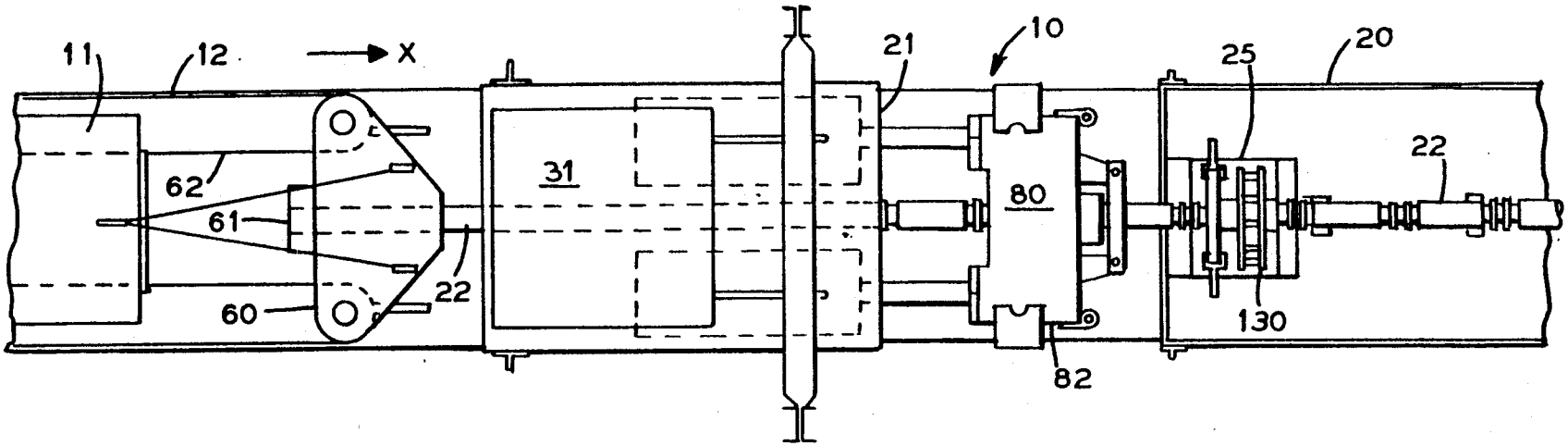
FIG. 2 is a schematic plan view of the puller unit of the apparatus of FIG. 1.
Figure 3:
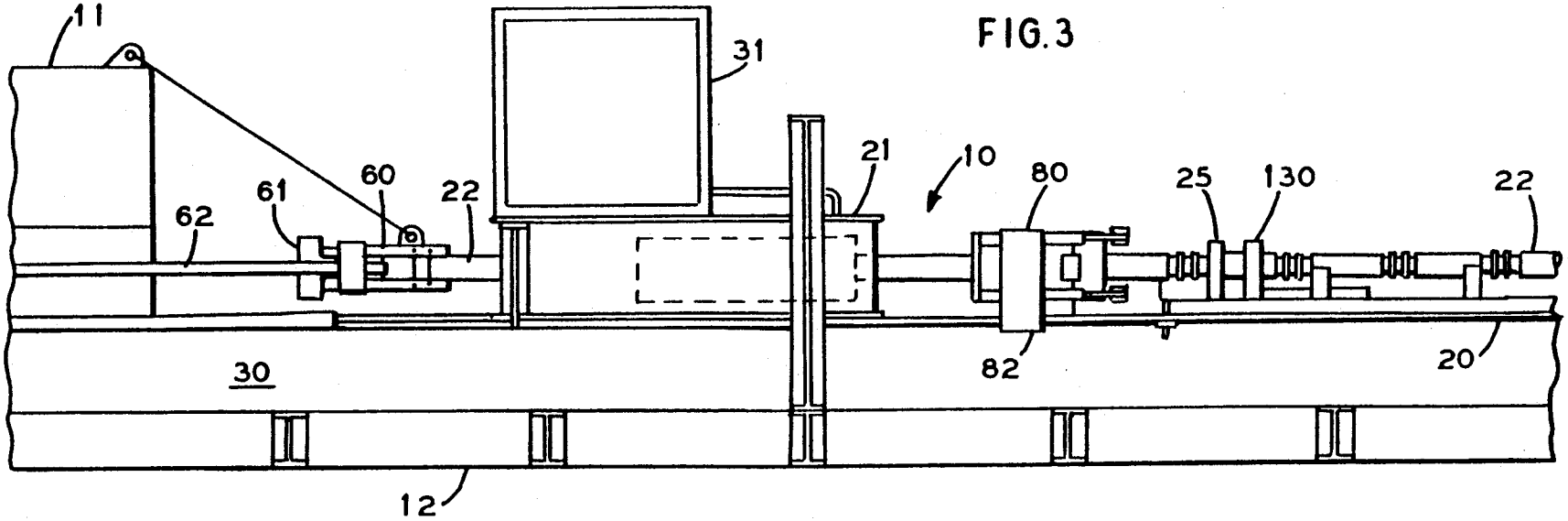
FIG. 3 is a side view of the illustration of FIG. 2.

Referring to FIGS. 2 and 3, system 10 according to the present invention is shown in more detail. System 10 comprises an elongated frame 20 comprising a skidway 30 along which the object (jacket 11) may move. This system 10 comprises puller unit 21 which is powered by hydraulic unit 31. Pulling rod 22 is attachable to the object to be pulled, passes through puller unit 21, and extends along the length of frame 20. Puller unit 2 comprises gripper unit 80 which is adapted to grip rod 22 so that puller unit 21 can pull rod 22 along in a direction indicated by arrow X. After rod 22 has been moved some distance in direction X, gripper unit 80 will release rod 22 and move back to its original position to re-grip rod 22 at a second point, where the pulling begins again. In this way, the object to be moved which is attached to a remote end of rod 22 is gradually pulled in direction X towards barge 12.

Figure 4:
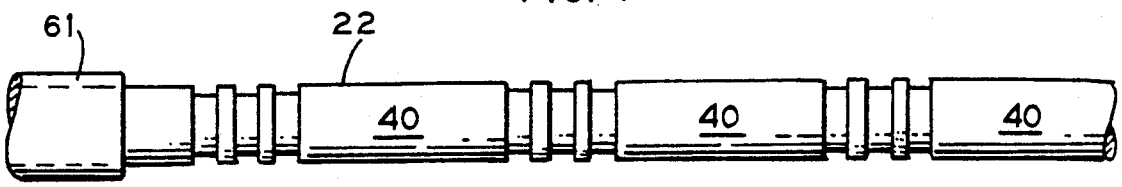
FIG. 4 is a schematic representation of a pull rod according to the present invention.

Referring to FIG. 4, the structure of rod 22 is shown in more detail. Rod 22 comprises a plurality of rod sections 40 that are connected to one another by means of screw threads which may be any convenient thread type. Each rod section 40 in this example is approximately 6000 mm in length. Any number of rod sections 40 may be interconnected with one another to produce a rod 22 having the appropriate length.

Figure 5:
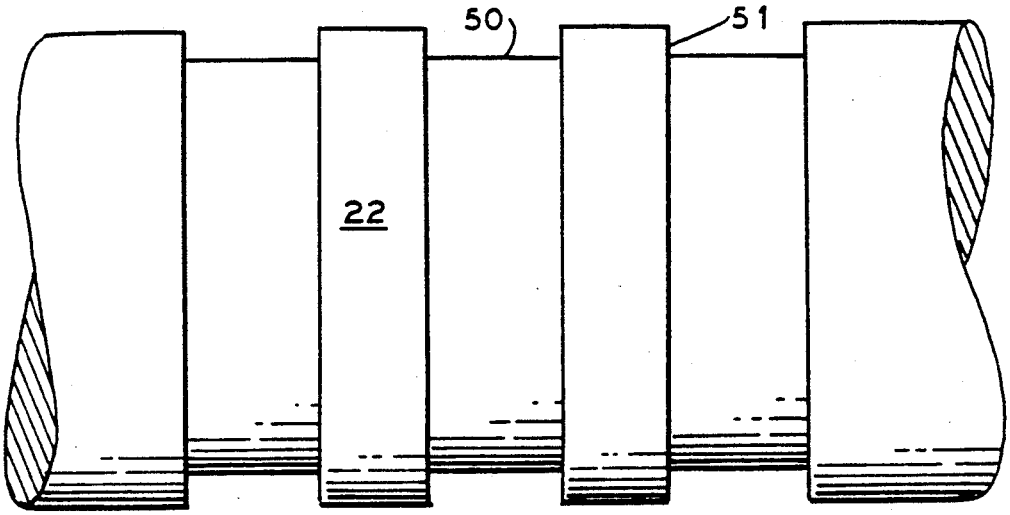
FIG. 5 is a detailed enlargement of a portion of the rod of FIG. 4.

Referring to FIG. 5, the interconnection between two adjacent rod sections 40 is shown in more detail. In this example, the interconnection portion 50 comprises a plurality of grooves 51 although rods having smooth surfaces are equally useful in the present invention. FIGS. 11 and 12 illustrate two alternative embodiments of the screw thread arrangement for connecting adjacent rod sections 40.

Referring to FIGS. 7 to 10, gripper unit 80 of puller unit 21 is shown in more detail. Gripper unit 80 comprises a plurality of tapered wedge portions 81 which are dimensioned to fit around and clamp onto the circumference of rod 22. These wedge fit within tapered opening 83 and are held together by crosshead 82. To release its grip on rod 22, crosshead 82 is moved with respect to wedge portions 81 thereby releasing their grip on rod 22. Both wedge blocks or other gripper blocks may be used to engage rod 22.

Figure 6:
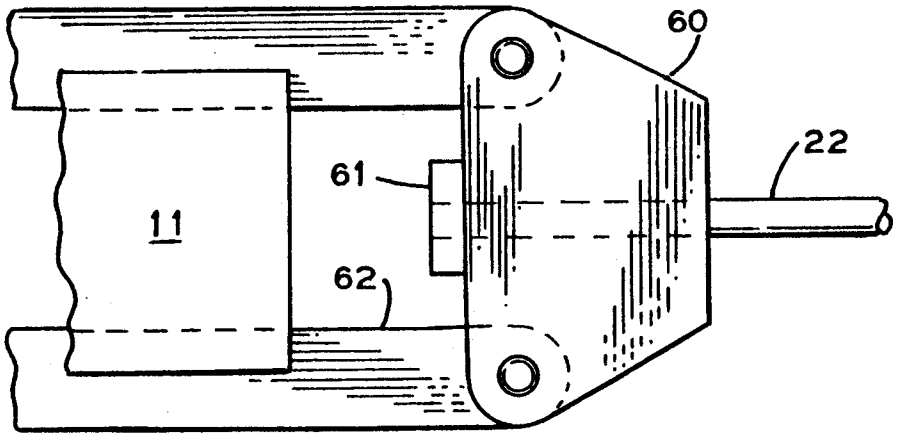
FIG. 6 is a schematic plan view representation of the connection plate used to connect the object to be pulled to one end of the rod.

The object to be moved, jacket 11, is connected to rod 22 by means of connection plate 60 (FIG. 6). A leg or other suitable member of jacket 11 is welded to connection plate 60. Rod 22 is connected to plate 60 by means of bobbin 61 which allows rod 22 to move relative to jacket 11 and plate 60. Such an arrangement is of importance due to the size of jacket 11. When puller unit 21 ceases to pull rod 22, jacket 11 will have built up a large amount of momentum. In order to prevent rod 22 from buckling when pulling ceases, connection plate 60 allows jacket 11 to continue moving after rod 22 has stopped moving. This movement is possible due to the fact that rod 2 is not connected directly to plate 60 and also to the internal cavity 62 which results in there being a distance between rod 22 and jacket 11. The dimensions of connection plate 60 may be varied to suit the size of the object being moved and the distance over which it is to be moved.

In order to avoid rod 22 sagging over its length, support structures 130 (FIG. 13) are positioned at spaced intervals along the length of rod 22 up to the point of pulling unit 21. Support structures 130 comprise a cradle into which rods 22 may be positioned.

After rod 22 has passed through pulling unit 21, uncoupler 25 acts to unscrew end rod sections 40 of rod 22. Sections 40 unscrewed in this way are collected and may be used again.

Figure 14:
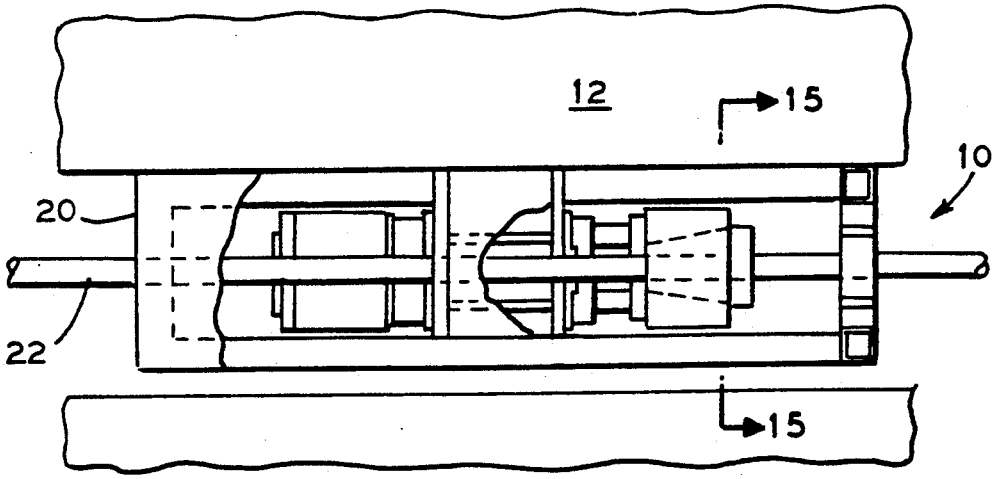
FIGS. 14 and 15 are schematic views illustrating an alternative embodiment of the present invention.
Figure 7:
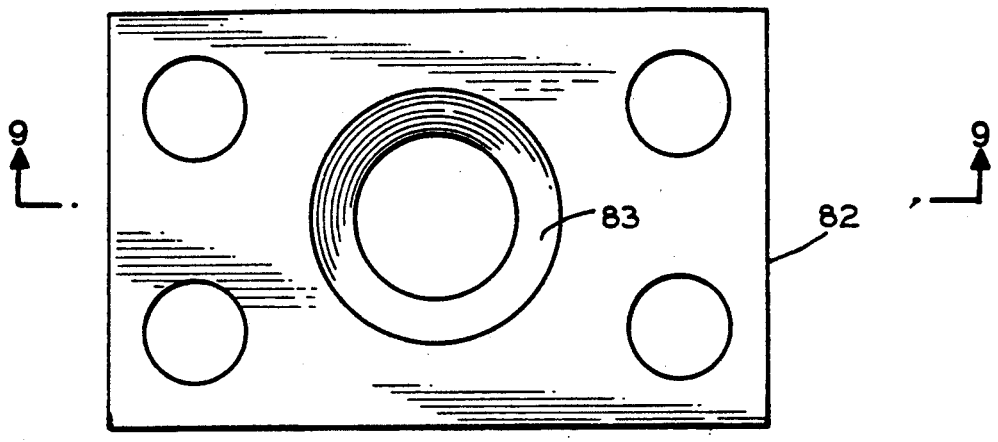
FIGS. 7 to 10 are schematic diagrams of a gripper unit according to the present invention.
Figure 9:
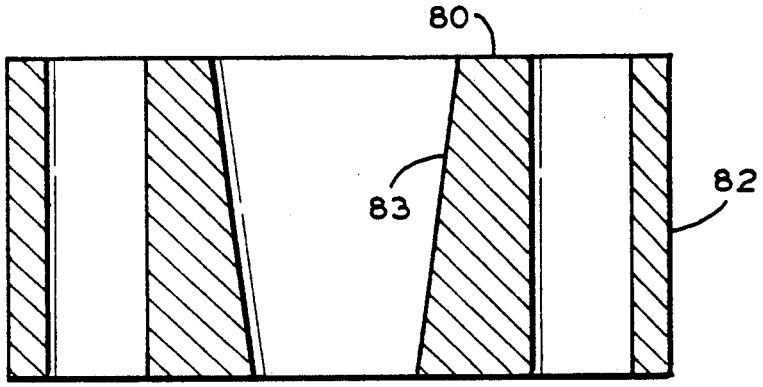
Figure 10:
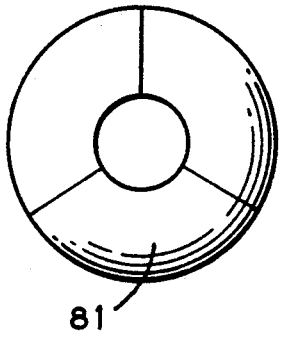
Figure 8:
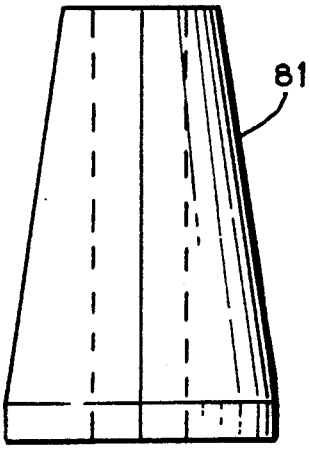
Figure 15:
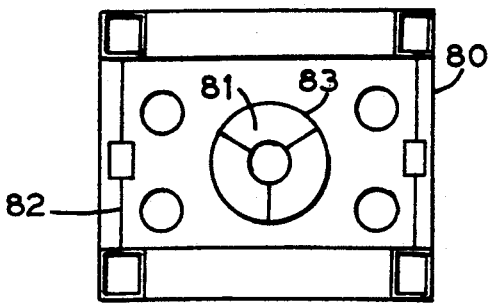

FIGS. 14 and 15 illustrate a second embodiment of the invention which comprises two puller units 21 positioned to pull in opposite directions, and to fail to a safe locked position when not being operated. Such a system allows an object to be moved in two directions by the operation of one of the selected units 21. The operation of each such puller unit 21 is the same as described above with the exception of pulling rod 22 which is of continuous design and does not unscrew or screw into shorter lengths. Rod 22 instead is secured at each end.

What is claimed is:

1. A pulling apparatus for pulling or moving a large object comprising:
   (a) an elongated frame;
   (b) a skid track secured to said frame upon which the large object is moved;
   (c) a puller unit for pulling the large object along said track;
   (d) pulling means coupled between the object and said puller unit for enabling the object to be pulled along said track by said puller unit pulling on said pulling means, said pulling means comprising a single rod formed from a plurality of rod sections removable secured to one another to form a rod of a predetermined length; and,
   (e) connecting means for connecting said rod to the object, said connecting means permitting relevant movement between the object and said rod thereby enabling the object to move relative to said rod.

2. The apparatus as set forth in claim 1 wherein said connecting means is located adjacent said skid track thereby reducing any moment upon the object associated with said rod.

3. The apparatus of claim 2 wherein said rod sections are re-usable and are threadably connected together.

4. The apparatus of claim 3 wherein said puller unit further comprises a gripping unit for gripping said rod thereby enabling said puller unit to pull the object along said track, said gripping unit is configured to grip said rod and then to release its grip on said rod and reposition itself with respect to said rod before regripping said rod in order to initiate further movement of the object along said track.

5. The apparatus of claim 4 wherein said rod comprises grooves along its length configured to be gripped by said gripping unit.

6. The apparatus of claim 5 wherein said gripping unit comprises two or more wedge-shaped portions configured to engage said grooves in said rod thereby gripping said rod during pulling.

7. The apparatus of claim 6 further comprising a crosshead which contains said wedge-shaped portions therein.

8. The apparatus of claim 7 further comprising a plurality of support structures located along said frame to support said rod therein.

9. The apparatus of claim 8 wherein said puller unit is hydraulically operated.

* * * * *